US009394903B2

(12) United States Patent
Jablonski et al.

(10) Patent No.: US 9,394,903 B2
(45) Date of Patent: Jul. 19, 2016

(54) DUAL MECHANICAL SEAL WITH EMBEDDED BEARING FOR VOLATILE FLUIDS

(71) Applicants: Joseph Jablonski, Monroe, NC (US); Colette Doll Greene, Mint Hill, NC (US)

(72) Inventors: Joseph Jablonski, Monroe, NC (US); Colette Doll Greene, Mint Hill, NC (US)

(73) Assignee: Imo Industries, Inc., Hamilton, NJ (US)

( * ) Notice: Subject to any disclaimer, the term of this patent is extended or adjusted under 35 U.S.C. 154(b) by 108 days.

(21) Appl. No.: 14/105,850

(22) Filed: Dec. 13, 2013

(65) Prior Publication Data

US 2015/0167671 A1 Jun. 18, 2015

(51) Int. Cl.

| | |
|---|---|
| ***F01C 21/04*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 29/02*** | (2006.01) |
| ***F04C 18/16*** | (2006.01) |
| ***F04C 15/06*** | (2006.01) |
| ***F04C 2/16*** | (2006.01) |

(52) U.S. Cl.

CPC ..... *F04C 15/0038* (2013.01); *F04C 2/165* (2013.01); *F04C 15/0088* (2013.01); *F04C 15/0092* (2013.01); *F04C 15/06* (2013.01); *F04C 18/16* (2013.01); *F04C 29/02* (2013.01); *F04C 29/025* (2013.01); *F04C 2230/60* (2013.01); *F04C 2240/50* (2013.01); *F04C 2270/46* (2013.01)

(58) Field of Classification Search

CPC ..... F04C 2/1073; F04C 2/1074; F04C 2/165; F04C 15/06; F04C 15/0088; F04C 15/0092; F04C 18/16; F04C 29/02; F04C 29/025; F04C 2230/60; F04C 2230/601; F04C 2240/50; F04C 2270/46

USPC ..... 418/1, 15, 48, 83, 98, 102, 197, 201.1; 29/888.023

See application file for complete search history.

(56) References Cited

U.S. PATENT DOCUMENTS

| | | | | |
|---|---|---|---|---|
| 3,637,329 | A * | 1/1972 | Sato et al. | 417/360 |
| 5,232,333 | A * | 8/1993 | Girault | 415/58.5 |
| 6,095,780 | A * | 8/2000 | Ernens | 418/104 |
| 2009/0140495 | A1* | 6/2009 | Dreifert et al. | 277/431 |
| 2011/0135528 | A1* | 6/2011 | Amano | 418/98 |
| 2012/0230857 | A1* | 9/2012 | Noguchi | 418/201.1 |

* cited by examiner

*Primary Examiner* — Theresa Trieu

(57) ABSTRACT

A fluid pump configured to prevent contact between volatile fluids and a ball bearing of the pump while providing the ball bearing with adequate lubrication. The fluid pump includes a pump casing having a fluid inlet and a fluid outlet, and a rotor set disposed within the pump casing for conveying fluid from the fluid inlet to the fluid outlet. The fluid pump further includes a recirculation chamber located adjacent the fluid outlet for collecting leaked fluid. The leaked fluid may be conveyed from the recirculation chamber back to the fluid inlet due to a pressure differential therebetween. The fluid pump may further include first and second seals that surround a drive shaft of the rotor, the first and second fluid seals defining a lubricant chamber therebetween that houses a ball bearing of the pump and that is filled with a continuously circulated, nonvolatile lubricant.

10 Claims, 7 Drawing Sheets

DUAL MECHANICAL SEAL WITH EMBEDDED BEARING FOR VOLATILE FLUIDS

FIELD OF THE DISCLOSURE

Embodiments of the present invention relate generally to the field of fluid pumps, and more particularly to a fluid pump having a double mechanical seal arrangement with an embedded ball bearing for pumping volatile fluids.

BACKGROUND OF THE DISCLOSURE

A conventional screw pump typically includes an elongated pump casing having a fluid inlet located adjacent a first longitudinal end thereof and a fluid outlet located adjacent a second longitudinal end thereof. A rotatably driven screw (commonly referred to as a "power rotor") and two or more intermeshing idler rotors extend through the pump casing and operate to drive fluid from the fluid inlet to the fluid outlet. An end of the power rotor nearest the fluid outlet often extends through a ball bearing that supports the power rotor and allows the power rotor to rotate freely about its axis with minimal frictional resistance. The power rotor typically also extends through a mechanical seal that separates the pumped fluid from the ball bearing. This mechanical seal is intended to prevent the pumped fluid from leaking out of the pump and/or from interfering with the operation of the bearing.

A problem commonly associated with screw pumps of the type described above is that the mechanical seal may fail over time, thus allowing quantities of pumped fluid to come into contact with the ball bearing. Since some pumped fluids can be highly volatile and have low flash points, and since ball bearings generally may become very hot (e.g., 200 degrees Fahrenheit) during pump operation, leakage of pumped fluids presents a significant risk of fire and/or explosion. Even in pumps in which ball bearings operate at relatively low temperatures (e.g., in pumps that are operated at relatively low speeds), leaked fluids may wash lubricant out of a ball bearing, thereby resulting in increased friction and heat within the ball bearing which increases the risk of fluid combustion.

Thus, there is a need for an improved seal and bearing design that addresses the above deficiencies in the art.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments of the present disclosure are generally directed to a screw pump having a double seal bearing arrangement and a method of implementing the same that effectively prevent contact between a pumped fluid and a ball bearing of the pump while providing the ball bearing with continuous lubrication.

The pump of the present disclosure may include a pump casing having a fluid inlet and a fluid outlet. A rotor set is disposed within the pump casing for conveying fluid from the fluid inlet to the fluid outlet. The fluid pump further includes a recirculation chamber located adjacent the fluid outlet for collecting leaked fluid. The recirculation chamber may be in fluid communication with the fluid inlet, whereby the leaked fluid may be conveyed from the recirculation chamber back to the fluid inlet due to a pressure differential therebetween. The fluid pump may further include first and second seals that surround a drive shaft of the rotor, the first and second fluid seals defining a lubricant chamber therebetween that houses a ball bearing of the pump and that is filled with a continuously circulated, nonvolatile lubricant.

A method for implementing the pump of the present disclosure may include pumping a fluid from a fluid inlet at an upstream end of the pump to a fluid outlet at a downstream end of the pump, wherein a quantity of the pumped fluid leaks into, and is collected in, a recirculation chamber, and conveying the collected leaked fluid out of the recirculation chamber. The method may further include circulating a lubricating fluid through a lubrication chamber defined by first and second seals that surround a drive shaft of the pump, wherein the lubrication chamber houses a ball bearing that surrounds and supports the drive shaft.

BRIEF DESCRIPTION OF THE DRAWINGS

By way of example, specific embodiments of the disclosed device will now be described, with reference to the accompanying drawings, in which.

DETAILED DESCRIPTION

Figure 1:
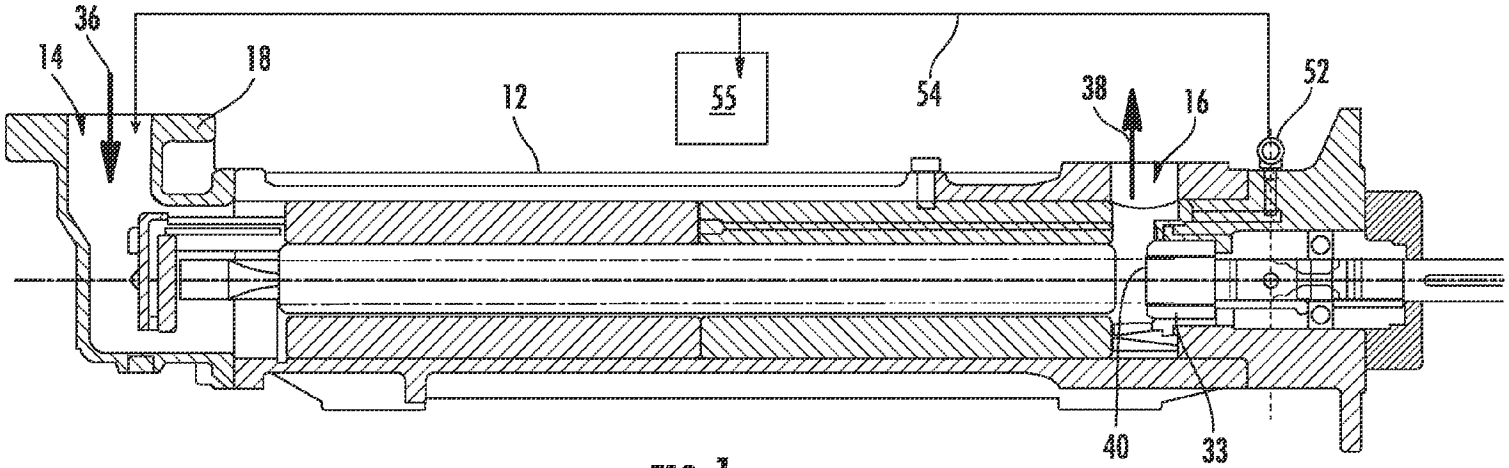
FIG. 1 is a side cross section view illustrating an exemplary fluid pump in accordance with the present disclosure.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 shows a sectional side view of an exemplary pump with a double mechanical seal arrangement (hereinafter referred to as "the pump 10") in accordance with an embodiment of the present disclosure. For the sake of convenience and clarity, terms such as "top," "bottom," "lateral," "longitudinal," "up," "down," "upstream," "downstream," "inwardly," and "outwardly" will be used herein to describe the relative placement and orientation of the pump 10 and its various components, all with respect to the geometry and orientation of the pump 10 as it appears in FIG. 1. Particularly, the term "upstream" shall refer to a position nearer the left side of FIG. 1 and the term "downstream" shall refer to a position nearer the right side of FIG. 1.

Referring to FIG. 1, the pump 10 may include an elongated, substantially cylindrical pump casing 12 having a fluid inlet 14 located at an upstream end thereof and a fluid outlet 16 located at a downstream end thereof. The fluid inlet 14 may be defined by an inlet head 18 that is axially coupled to the pump casing 12. Alternatively, it is contemplated that the fluid inlet 14 may be formed as an integral part of the pump casing 12, such as in a sidewall thereof.

Figure 2:
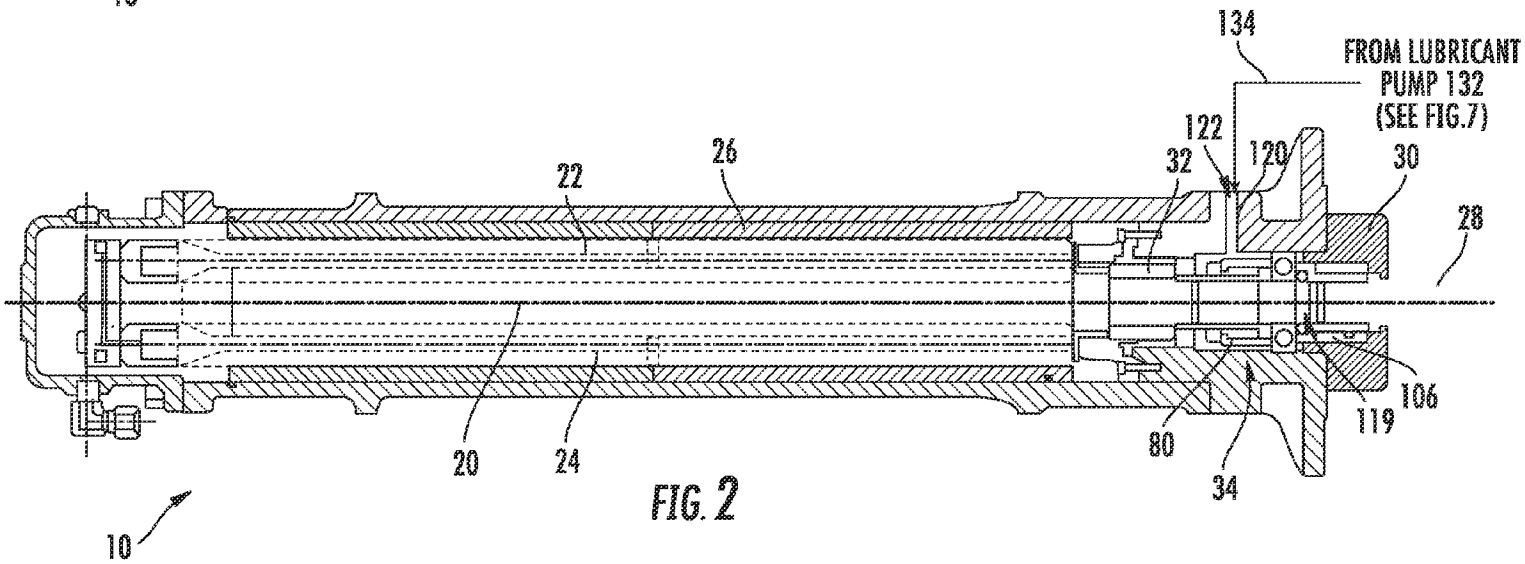
FIG. 2 is a top cross section view illustrating the exemplary fluid pump of FIG. 1.

Referring to the sectional top view of the pump 10 shown in FIG. 2, the pump 10 may further include a central power rotor 20, two inlet idler rotors 22, and two outlet idler rotors 24, all mounted for rotation about their respective longitudinal axes in a rotor housing 26 within the pump casing 12. The power rotor 20 may include a coaxial drive shaft 28 that extends through an end cap 30 of the pump 10 for coupling the power rotor 20 to a drive mechanism (not shown), such an electric motor, which when activated may rotate and drive the power rotor 20 about its longitudinal axis. The drive shaft 28 may be supported by a balance piston 32 and a double-seal bearing assembly (hereinafter referred to as "the bearing assembly 34") which will be described in greater detail below.

The power rotor 20 may have a larger outside diameter than the idler rotors 22 and 24. Each of the rotors 20-24 may be provided with a generally helical screw thread (not shown) that extends between the fluid inlet 14 and the fluid outlet 16. The power rotor 20 may be disposed laterally intermediate the four idler rotors 22 and 24 such that the screw thread of the power rotor 20 intermeshes with the screw threads of the idler rotors 22 and 24. The longitudinal axes of the rotors 20-24 are generally parallel, and thus rotation of the power rotor 20 about its axis causes the idler rotors 22 and 24 to rotate about their respective longitudinal axes.

During normal operation of the pump 10, the drive mechanism (e.g. electric motor) coupled to the drive shaft 28 may be activated to cause rotation of the power rotor 20 about its axis, which in turn causes rotation of the idler rotors 22 and 24 about their respective axes as described above. Fluid may be pushed into the fluid inlet 14 by atmospheric pressure (as indicated by the arrow 36 in FIG. 1) between the screw threads at the upstream ends of the rotors 20-24. As the rotors 20-24 turn, the meshing of their threads creates fluid chambers that are bounded by the threads and the interior surface of the rotor housing 26. The fluid becomes trapped in the fluid chambers, and continued rotation of the rotors 20-24 and their screws causes the fluid chambers and the fluid contained therein to move from the upstream end of the rotors 20-24 toward the downstream end of the rotors 20-24. The conveyed fluid then confronts the upstream face 40 of the balance piston 32 and is discharged from the pump 10 via the fluid outlet 16 (as indicated by the arrow 38 in FIGS. 1 and 3) as a consequence of the fluid being displaced from the fluid chambers as the screw threads at the downstream end of the rotors 20-24 mesh.

Figure 3:
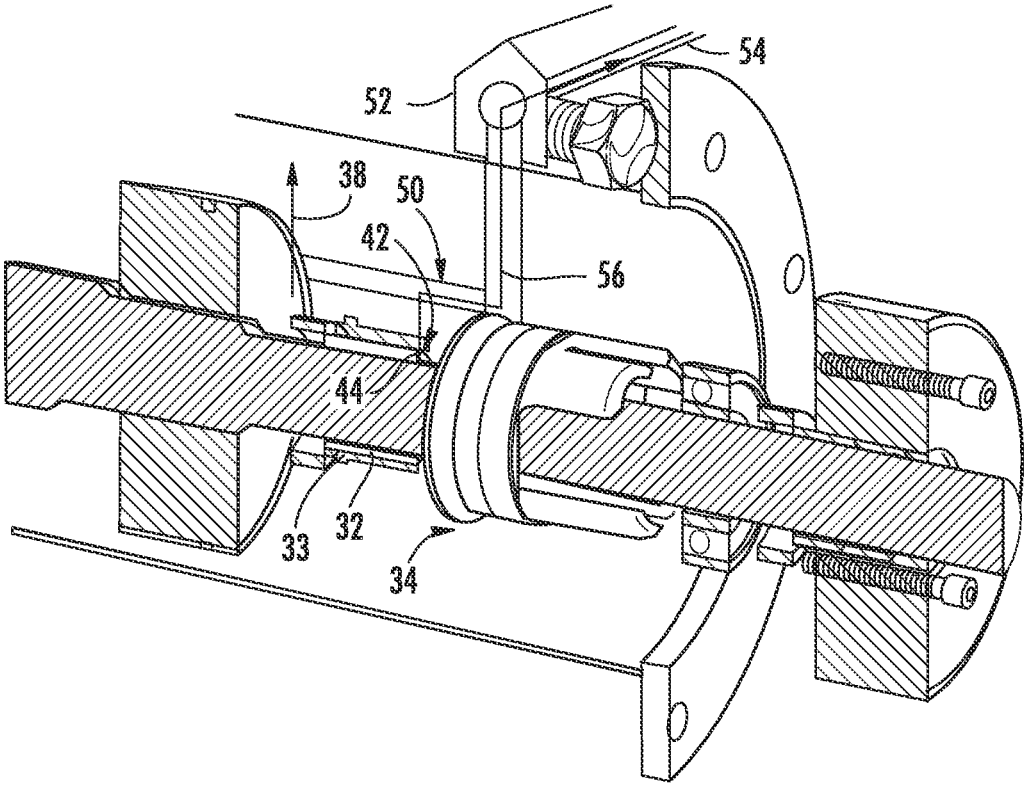
FIG. 3 is an isometric cutaway view illustrating an outlet end of the exemplary fluid pump of FIG. 1.

While a majority of the conveyed fluid is discharged through the fluid outlet 16, some of the fluid may leak between the power rotor balance piston 32 and the balance piston bushing 33 within the pump casing 12. Referring to FIG. 3, such leaked fluid may then enter a recirculation chamber 42 located between a rear face 44 of the balance piston 32 and a forward end of the bearing assembly 34. In the illustrated embodiment the recirculation chamber 42 defines a substantially annular chamber that surrounds the power rotor 20 and/or a portion of the bearing assembly 34.

A recirculation channel 50 may be formed in the pump casing 12 and may extend from the recirculation chamber 42 to an outlet port 52 on the exterior of the pump casing 12. A recirculation line 54 (best shown in FIG. 1) may be connected to the outlet port 52 and may extend back to the fluid inlet 14 or to a fluid source 55 (e.g. a tank) of the fluid being pumped. The leaked fluid may thereby be conveyed from the recirculation chamber back to the fluid inlet 14 (as indicated by the arrow 56 in FIG. 3) due to a pressure differential between the recirculation chamber 42 and the fluid inlet 14 (i.e. because fluid moving across the balance piston bushing 33 will always be at higher pressure than the fluid in the fluid inlet 14). The leaked pumped fluid is thereby recirculated through the pump 10 and is not allowed to leak into other parts of the pump 10 or out of the pump 10. Importantly, and as will be described in greater detail later, this arrangement also ensures that no pumped fluid reaches the ball bearing 88 (see FIG. 4), which, as previously described, may be operating at an elevated temperature.

Figure 4:
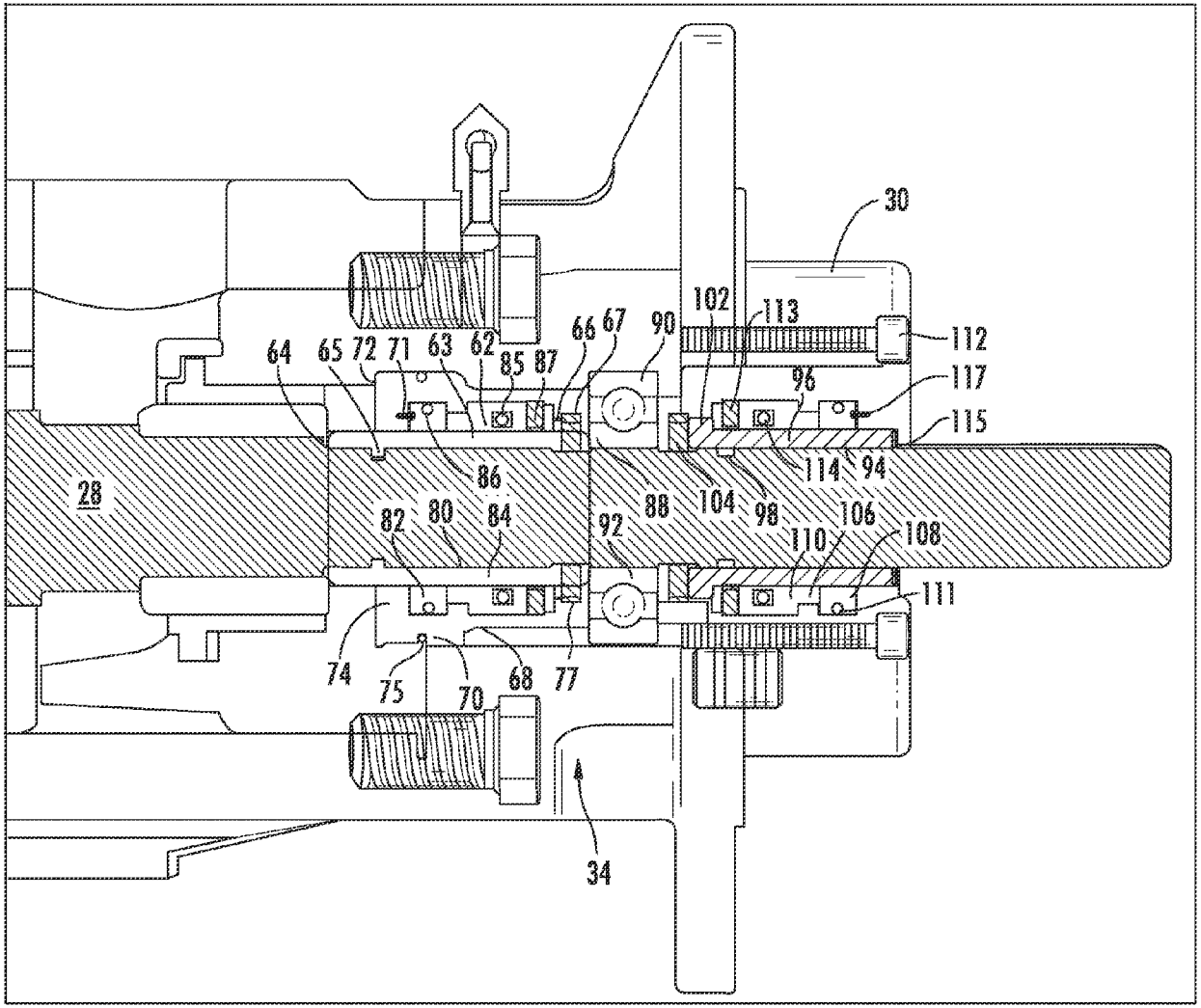
FIG. 4 is a side cross section view illustrating the outlet end of the exemplary fluid pump of FIG. 1.
Figure 5:
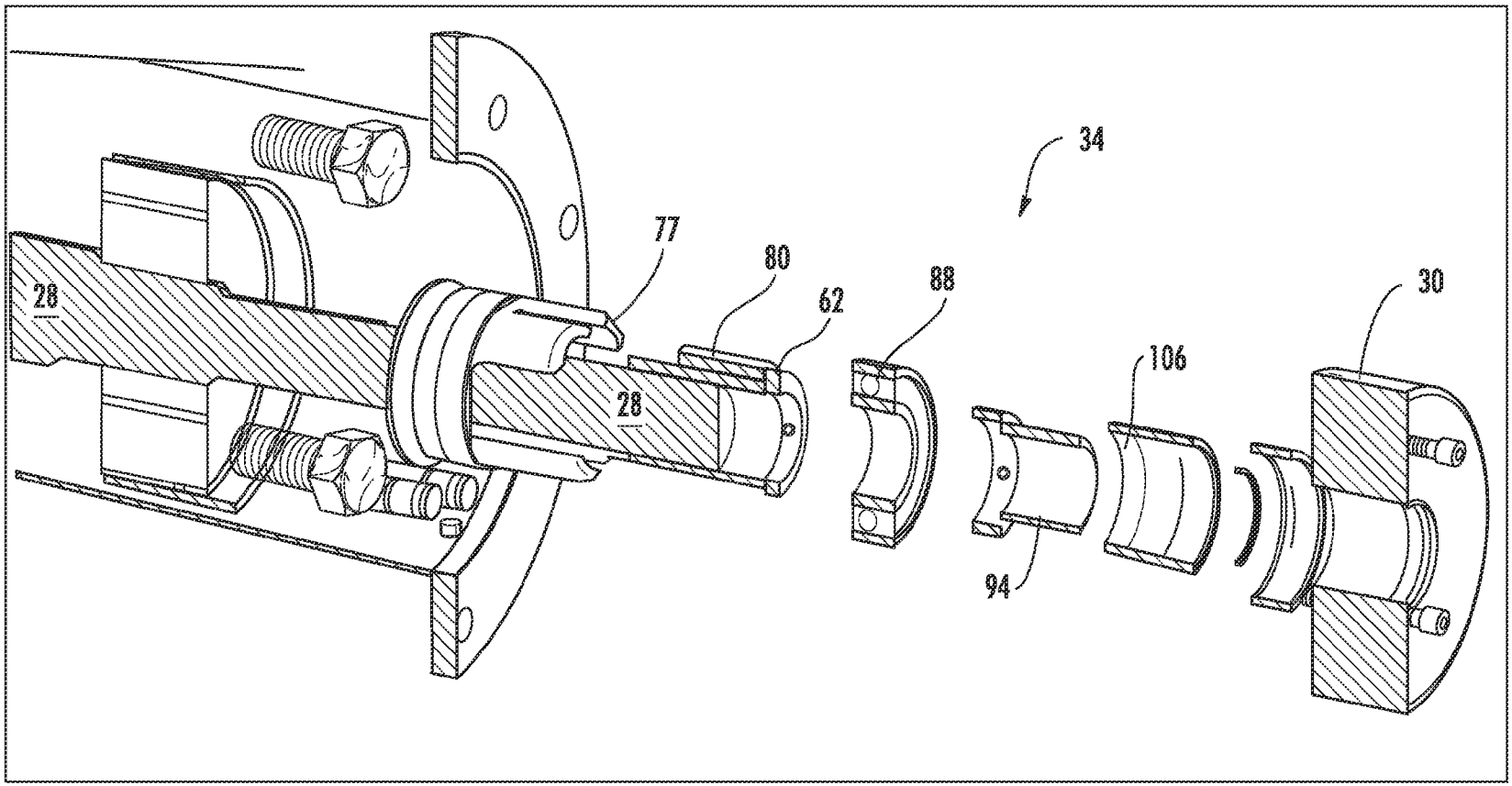
FIG. 5 is an exploded cross section view illustrating the outlet end of the exemplary fluid pump of FIG. 1.
Figure 6:
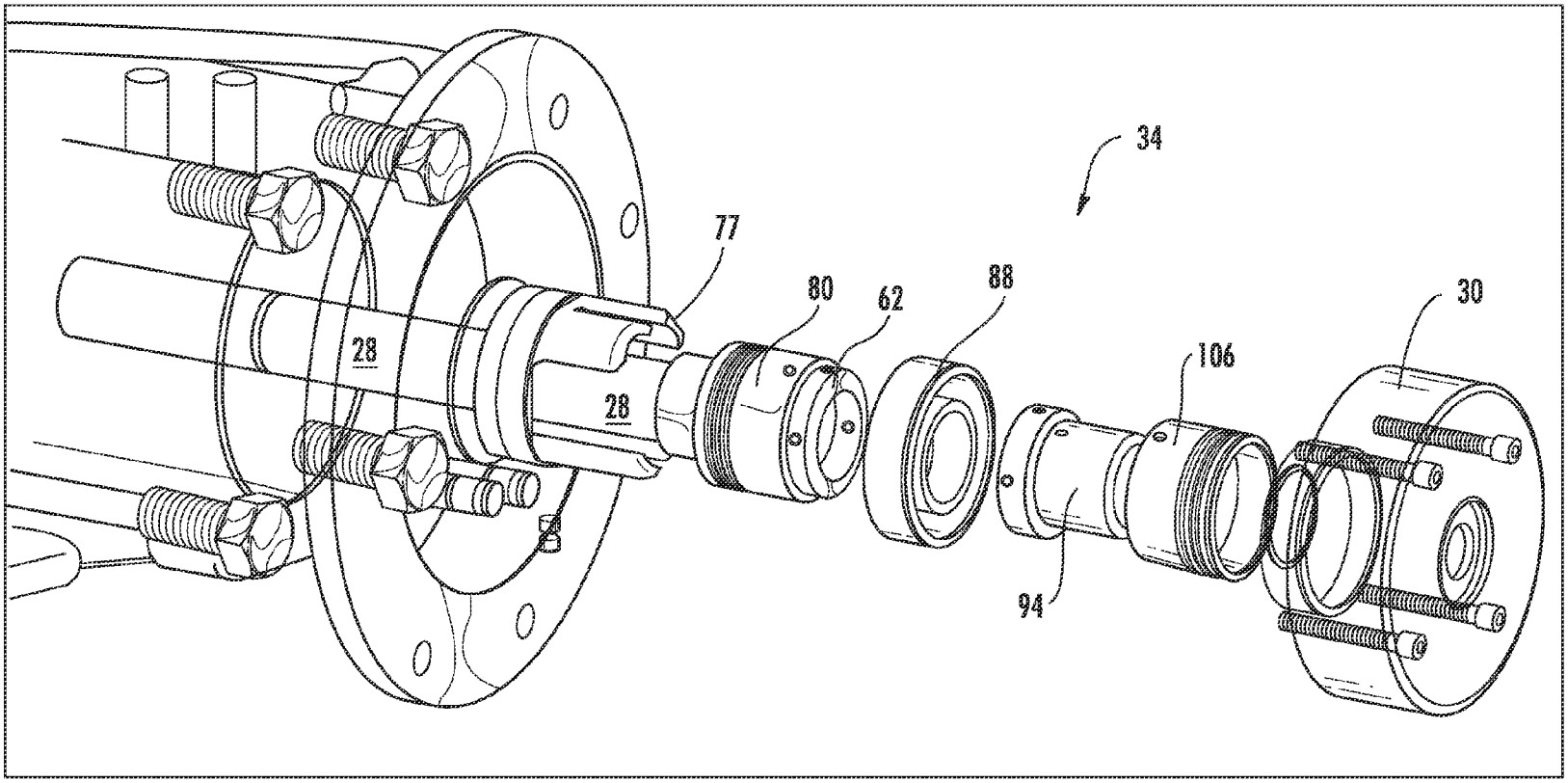
FIG. 6 is an partial exploded cross section view illustrating the outlet end of the exemplary fluid pump of FIG. 1.

FIGS. 4, 5, and 6 show respective side section, exploded section, and semi-exploded section views of the outlet end of the pump 10, including the bearing assembly 34. The bearing assembly 34 may include a first seal spacer 62 having a substantially cylindrical sidewall 63 that fits over the drive shaft 28 of the power rotor 20 in a radially close-clearance relationship therewith. The sidewall 63 may be sealed to the drive shaft 28 by an O-ring 65 disposed radially therebetween, such as may be seated in an annular channel formed in the drive shaft 28. An upstream end of the first seal spacer 62 may longitudinally abut an annular shoulder 64 formed in the drive shaft which prevents longitudinal movement of the first seal spacer 62 in the upstream direction. A downstream end of the first seal spacer 62 may define a radially-outwardly projecting annular flange 66. A plurality of set screws 67 may extend radially through the flange 66 and may engage the drive shaft 28, thereby fastening the first seal spacer 62 to the drive shaft 28 to prevent relative rotational movement therebetween.

The bearing assembly 34 may further include a seal seat 68 that fits over the first seal spacer 62 in a coaxial relationship therewith. The seal seat 68 may include an annular base portion 70 having a radially-inwardly extending annular flange 74 that surrounds the first seal spacer 62 in a radially close-clearance relationship therewith. The base portion 70 may be sealed to the pump casing 12 by an O-ring 75 disposed radially therebetween, such as may be seated in an annular channel formed in the base portion 70. The O-ring 75 may thereby prevent leakage between the seal seat 68 and the bearing assembly 34. An upstream end of the base portion 70 may longitudinally abut an annular shoulder 72 formed in the pump casing 12 which prevents longitudinal movement of the seal seat 68 in the upstream direction. The seal seat 68 may further include a plurality of circumferentially spaced, longitudinally-elongated fingers 77 (best shown in FIGS. 5 and 6) that extend downstream from the base portion 70 and that are radially spaced apart from the first seal spacer 62.

A first seal 80 may be disposed longitudinally intermediate the flange 74 of the seal seat 68 and the flange 66 of the first seal spacer 62 and radially intermediate the sidewall 63 of the first seal spacer 62 and the base portion 70 and fingers 77 of the seal seat 68. The first seal 80 may be a conventional multi-spring mechanical seal having a stationary portion 82 and rotating portion 84 that are rotatable relative to one another about their mutual axis. An O-ring 86 may be disposed radially intermediate the stationary portion 82 of the first seal 80 and the base portion 70 of the seal seat 68, thereby preventing leakage therebetween. A pin 71 may be disposed between the annular flange 74 and stationary portion 82 of the first seal 80 to prevent rotation therebetween, while the rotating portion 84 of the first seal 80 is engaged to the first seal spacer 62 by a plurality of set screws 87 to prevent the rotating portion 84 of the first seal 80 from rotating with respect to the first seal spacer 63. An O-ring 85 may be disposed radially intermediate the rotating portion 84 of the first seal 80 and the side wall 63 of the first seal spacer 62 thereby preventing leakage therebetween. Thus arranged, the rotating portion 84 may rotate with respect to the stationary portion 82 during operation of the pump 10.

The bearing assembly 34 may further include a ball bearing 88 that surrounds the drive shaft 28. The ball bearing 88 may be disposed downstream of, and may longitudinally abut, the flange 66 of the first seal spacer 62 and the fingers 77 of the seal seat 68. A radially outwardly-facing surface 90 of the ball bearing 88 may be disposed in a radially close clearance relationship with the pump casing 12, and a radially inwardly-facing surface 92 of the ball bearing 88 may radially engage the drive shaft 28. The ball bearing 88 may thereby provide the drive shaft 28 with axial support while allowing the drive shaft 28 to rotate freely and smoothly about its axis with minimal frictional resistance during operation of the pump 10.

The bearing assembly 34 may include a second seal spacer 94 having a substantially cylindrical sidewall 96 that fits over the drive shaft 28 in a radially close-clearance relationship therewith. The sidewall 96 may be sealed to the drive shaft 28 by an O-ring 98 disposed radially therebetween, such as may be seated in an annular channel formed in the drive shaft 28. A downstream end of the second seal spacer 94 may longitudinally abut a snap ring 115 on the shaft 28, which prevents longitudinal movement of the second seal spacer 94 in the downstream direction. An upstream end of the second seal spacer 94 may define a radially-outwardly projecting annular flange 102 that longitudinally abuts the ball bearing 88. A plurality of set screws 104 may extend radially through the flange 102 and may engage the drive shaft 28, thereby fastening the second seal spacer 94 to the drive shaft 28 to prevent relative rotational movement therebetween.

A second seal 106 may be disposed longitudinally intermediate the flange 102 of the second seal spacer 94 and the cap 30 and radially intermediate the sidewall 96 of the second seal spacer 94 and the cap 30. The second seal 106 may be a conventional multi-spring mechanical seal that is substantially identical to the first seal 80 (except reversed in orientation), having a stationary portion 108 and a rotating portion 110 that are rotatable relative to one another about their mutual axis. An O-ring 111 may be disposed radially intermediate the base portion 108 of the second seal 106 and the cap 30, thereby preventing leakage therebetween, A pin 117 may be disposed between the cap 30 and the stationary portion 108 of the second seal 106 to prevent rotation of the stationary portion 82 of the second seal 110 with respect to the second seal spacer seal 94, while the rotating portion 110 of the second seal 106 is engaged to the second seal spacer 94 by a plurality of set screws 113 to prevent the rotating portion 104 of the second seal from rotating with respect to the seal spacer 94. An O-ring 114 may be disposed radially intermediate the rotating portion 110 of the second seal 106 and the side wall of the 96 of the second seal spacer 94 thereby preventing leakage therebetween. Thus arranged, the rotating portion 106 of the second seal 110 may rotate with respect to the stationary portion 108 during operation of the pump.

The cap 30 of the pump 10 may fit over the drive shaft 28 and inside a portion of the bearing assembly 34 with the drive shaft 28 extending axially through the cap 30. The cap may be longitudinally affixed to the pump casing 12 by a plurality of bolts 112. With the cap 30 mounted thusly, the first and second seals 80 and 106 may be appropriately compressed within the bearing assembly 34 to achieve optimal sealing therein. The degree of such compression may be dictated by the dimensions of the first and second seal spacers 62 and 94, seal seat 68, bearing 90, and cap 30, and particularly the axial dimensions of such components, which may be selected to suit the dimensions and characteristics of the particular first and second seals 80 and 106 employed in a particular application.

Referring again to FIG. 2, the first and second seals 80 and 106 may define a substantially fluid-tight lubricant chamber 119 that encompasses the ball bearing 88 and the rotatably-interfacing portions of the first and second seals 80 and 106 (i.e. the opposing faces of the base portions 82 and 108 and body portions 84 and 110 of the first and second seals 80 and 106. The lubricant chamber 119 may be filled with an appropriate lubricating fluid having a significantly higher flash point than the fluid being pumped by the pump 10, including, but not limited to any fluid that has sufficient bearing qualities to lubricate and cool the ball bearing 90.

Figure 7:
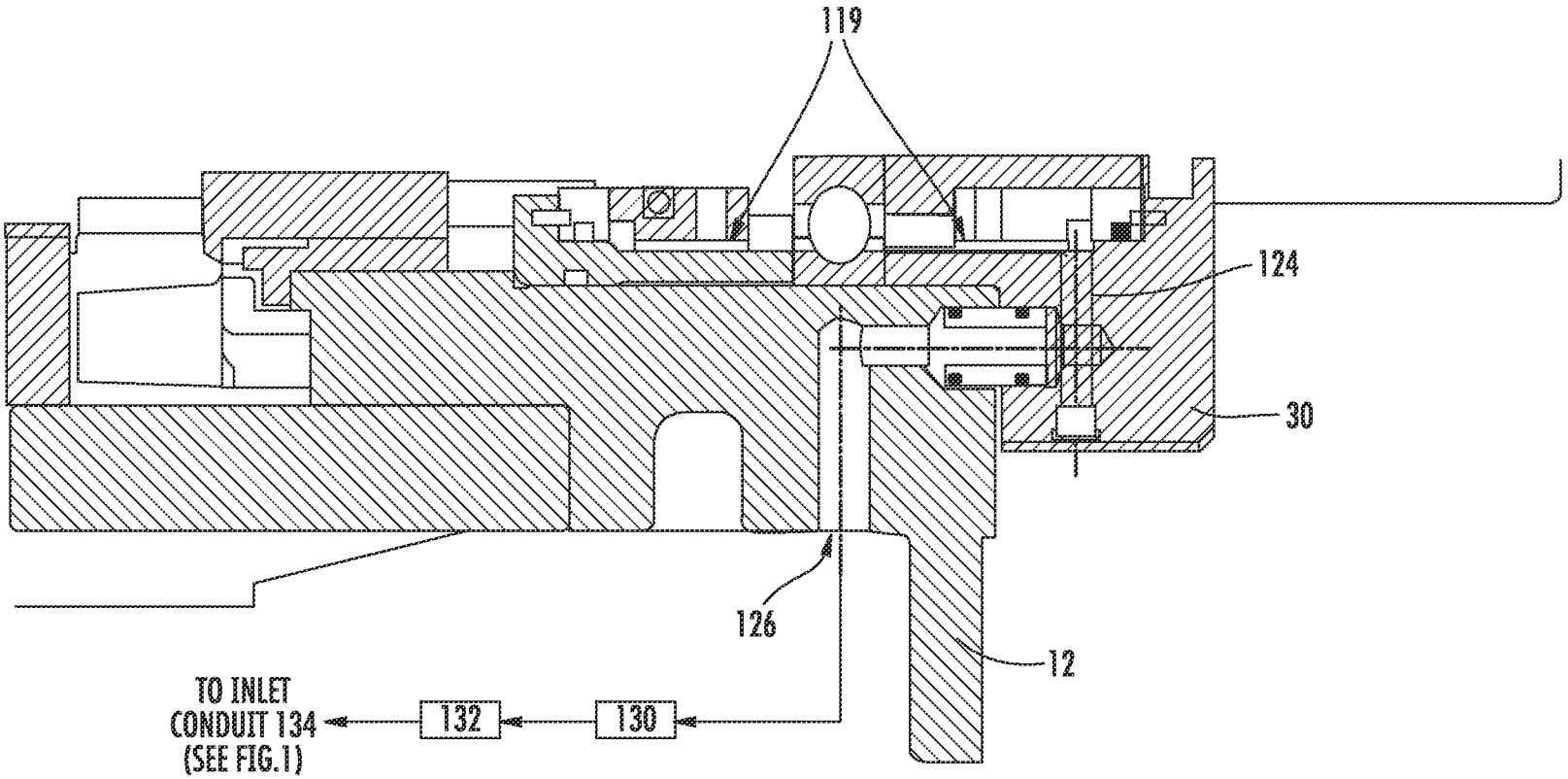
FIG. 7 is a detail cross section view illustrating a lower half of the outlet end of the exemplary fluid pump of FIG. 1.

A lubricant inlet channel 120 may be formed in the pump casing 12 and may extend from a lubricant inlet 122 at an exterior of the pump casing 12 to an upstream end of the lubricant chamber 119. As best seen in FIG. 7, a lubricant outlet channel 124 may be formed in the pump casing 12 and the cap 30, and may extend from a downstream end of the lubricant chamber 119 to a lubricant outlet 126 at an exterior of the pump casing 12. A lubricant outlet line 128 may extend from the lubricant outlet 126 to a lubricant tank 130 that contains a supply of the lubricating fluid. A lubricant pump 132 may be coupled between the lubricant tank 130 and a lubricant inlet line 134 that is connected to the lubricant inlet 122 (see FIG. 2). Although not shown, appropriate filtration, pressure sensing and temperature sensing instrumentation may be provided to ensure that the lubricant is maintained within desired pressure, temperature and quality ranges.

During operation of the pump 10, the lubricant pump 132 may operate to continuously circulate the nonvolatile lubricating fluid through the lubricant chamber 119. Particularly, the nonvolatile lubricating fluid may be pumped into the upstream end of the lubricant chamber 119 via the lubricant inlet 122, may flow over and through the first seal 80, the ball bearing 88, and the second seal 106, and may exit the downstream stream end of the lubricant chamber 119 via the lubricant outlet 124. Thus, the components of the bearing assembly 34 are continuously lubricated, thereby minimizing friction within the bearing assembly 34 and maintaining desired operating temperatures of these components during operation of the pump. This may significantly prolong the operating lives of the components of the bearing assembly 34, and particularly the ball bearing 88, relative to the operating lives of such components in conventional bearing/seal arrangements.

In some embodiments the nonvolatile lubricating fluid in the lubricant chamber 119 may be maintained at a pressure greater than the pressure of the volatile fluid collected in the recirculation chamber 42. This may be achieved by monitoring the pressures of the fluids with appropriately positioned sensors (not shown) and by manually or automatically regulating the pressure of the lubricant pump 132, for example. This is advantageous because it ensures that the volatile fluid being pumped by the pump 10 will not be able to enter the bearing assembly 34. For example, any leakage past the first seal 80 (e.g., during normal operation and/or due to wear and/or failure over time) will be of the lubricating fluid in the direction of the recirculation chamber 42, owing to the fact that it will be at a higher pressure than the volatile fluid in the recirculation chamber. Thus, lubricating fluid that leaks past the seal into the recirculation chamber 42 is collected and recirculated to the inlet 14 of the pump 10 (as described above), where it is mixed within the volatile pumped fluid.

The lower pressure pumped fluid is thereby prevented from leaking into the bearing assembly 34 (since it would be overcome by the flow of the higher pressure lubricating fluid) where it could otherwise come into contact with the relatively hot ball bearing 88 and create a risk of combustion.

Figure 8:
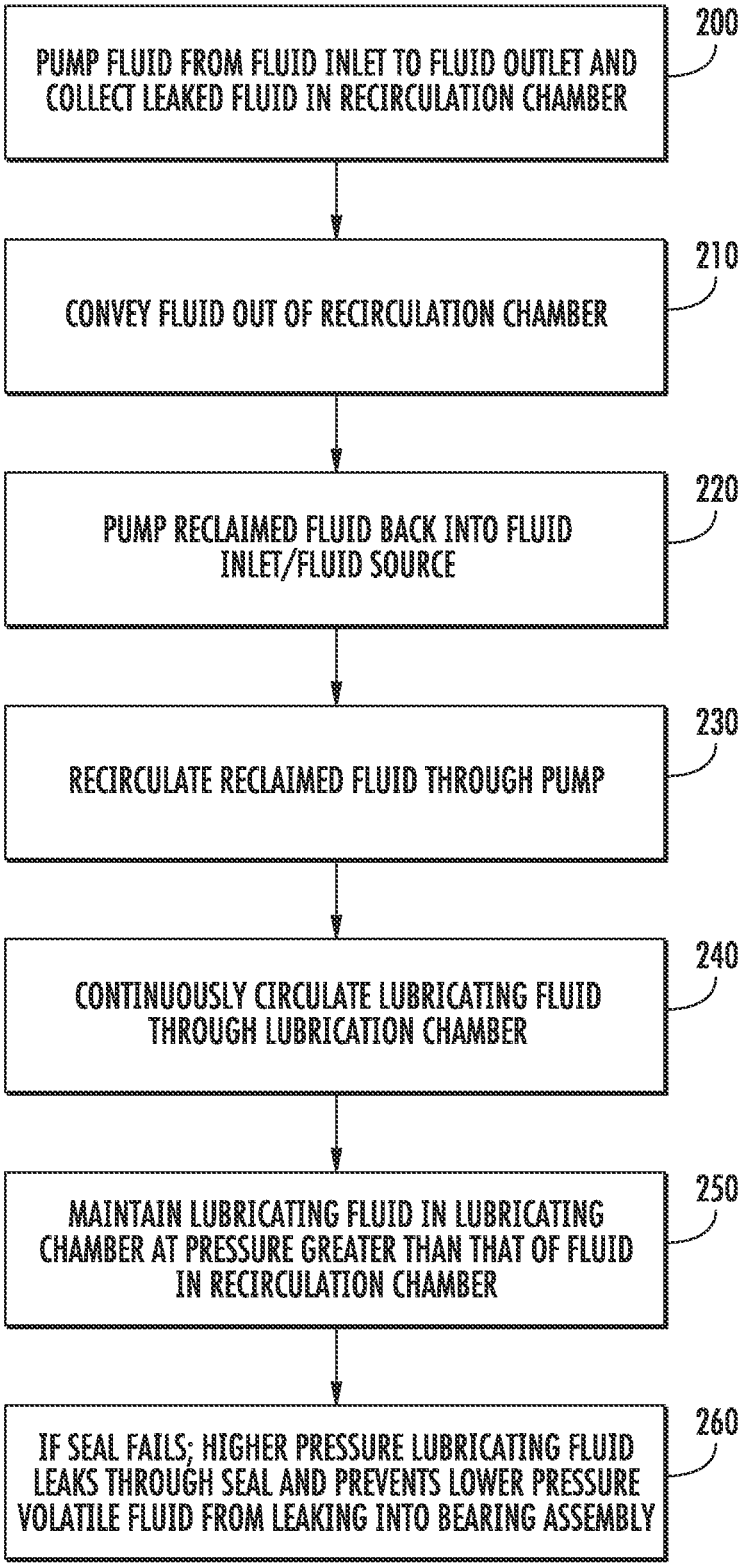
FIG. 8 is flow diagram illustrating an exemplary method of operating the fluid pump in accordance with the present disclosure.

Referring to FIG. 8, a method for operating the pump 10 in accordance with the present disclosure will now be described, with reference to the side and top section views of the pump 10 shown in FIGS. 1 and 2 and the perspective section view of the bearing assembly shown in FIG. 3.

At a first step 200 of the exemplary method, a fluid may be pumped from the fluid inlet 14 at the upstream end of the pump 10 to the fluid outlet 16 at the downstream end of the pump 10, whereby a quantity of the pumped fluid may leak into, and may be collected in, the recirculation chamber 42 disposed adjacent the fluid outlet 16 and upstream from the bearing assembly 34 of the pump.

At step 210 of the exemplary method, the fluid in the recirculation chamber 42 may be conveyed out of the recirculation chamber 42 via the recirculation channel 50 and the recirculation conduit 54. At step 220, this reclaimed fluid may be directed back to the fluid inlet 14 or to the fluid source 55 (e.g. a tank). At step 230, the reclaimed fluid may be recirculated through the pump 10.

At step 240, a lubricating fluid may be continuously circulated through the lubrication chamber 119 bounded by the first and second seals 80 and 106 and that contains the ball bearing 88 of the pump 10, wherein the lubricating fluid flows over and through the rotatably interfacing surfaces of the first and second seals 80 and 106 and the ball bearing 88.

At step 250, the nonvolatile lubricating fluid in the lubrication chamber 119 may be maintained at a fluid pressure that is greater than that of the relatively volatile fluid in the recirculation chamber 42. Thus, if the first seal 80 wears and or/fails, the higher pressure nonvolatile lubricating fluid in the lubrication chamber 119 may, at step 260, leak past the first seal 80 and into the recirculation chamber 42, whereby the lower volatile pumped fluid is prevented from leaking through the first seal 80 into the lubrication chamber 119 and coming into contact with the ball bearing 88.

In view of the forgoing, it will be appreciated that the apparatus and method of the present disclosure may effectively prevent contact between potentially volatile fluids that may be pumped by the pump 10 and the ball bearing 88 of the pump 10 while providing the ball bearing 88 with continuous and adequate lubrication, thereby mitigating the risk of combustion while simultaneously prolonging the operating life of the ball bearing 88 and other components of the pump 10.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

The invention claimed is:

1. A fluid pump comprising:

a pump casing having a fluid inlet and a fluid outlet;

a rotor disposed within the pump casing for conveying fluid from the fluid inlet to the fluid outlet;

a bearing assembly comprising:

first and second mechanical seals surrounding a drive shaft of the rotor downstream of the fluid outlet, the first and second mechanical seals defining a lubricant chamber therebetween; and a ball bearing disposed within the lubricant chamber and surrounding the drive shaft;

wherein the lubricant chamber contains a lubricating fluid having a higher flash point than the fluid conveyed by the rotor;

a recirculation chamber located adjacent the fluid outlet and upstream from the bearing assembly for collecting leaked fluid; and a recirculation conduit configured to convey the collected leaked fluid out of the recirculation chamber.

2. The fluid pump of claim 1, further comprising a lubricant pump disposed in fluid communication with the lubricant chamber, wherein the lubricant pump is configured to circulate the lubricating fluid through the lubricant chamber.

3. The fluid pump of claim 1, wherein the recirculation conduit is configured to convey the collected fluid to the fluid inlet.

4. The fluid pump of claim 1, wherein the recirculation conduit is configured to convey the collected fluid to a fluid source.

5. The fluid pump of claim 1, wherein the lubricating fluid in the lubricant chamber is maintained at a pressure that is higher than a pressure of the fluid in the recirculation chamber.

6. A method of operating a fluid pump, the method comprising:

pumping a fluid from a fluid inlet at an upstream end of the pump to a fluid outlet at a downstream end of the pump, wherein a quantity of the pumped fluid leaks into, and is collected in, a recirculation chamber disposed between the fluid outlet and a bearing assembly;

conveying the collected leaked fluid out of the recirculation chamber via a recirculation conduit; and circulating a lubricating fluid through a lubrication chamber defined by first and second seals that surround a drive shaft of the pump, wherein the lubrication chamber houses a ball bearing that surrounds and supports the drive shaft, the lubricating fluid having a higher flash point than the fluid pumped from the fluid inlet to the fluid outlet.

7. The method of claim 6, wherein the step of conveying the collected leaked fluid out of the recirculation chamber further comprises directing the collected leaked fluid to the fluid inlet for recirculation through the pump.

8. The method of claim 6, wherein the step of circulating the lubricating fluid through the lubrication chamber comprises pumping the lubricating fluid into an upstream end of the lubrication chamber, allowing the lubricating fluid to flow over surfaces of the first seal, the ball bearing, and the second seal, and pumping the lubricating fluid out of a downstream end of the lubrication chamber.

9. The method of claim 6, further comprising maintaining the lubricating fluid in the lubrication chamber at a higher pressure than a pressure of the fluid in the recirculation chamber.

10. The method of claim 9, wherein the step of maintaining the lubricating fluid at a higher fluid pressure than the fluid in the recirculation chamber comprises monitoring the fluid pressure of the lubricating fluid in the lubrication chamber and the fluid pressure of the fluid in the recirculation chamber and automatically adjusting a pressure of a pump that drives the lubricating fluid through the lubrication chamber.

* * * * *